United States Patent [19]

Ferguson

[11] 4,404,619

[45] Sep. 13, 1983

[54] ILLUMINATOR BOX

[76] Inventor: Bruce A. Ferguson, 233 S. Quincy, Hinsdale, Ill. 60521

[21] Appl. No.: 349,827

[22] Filed: Feb. 18, 1982

[51] Int. Cl.[3] ..... F21S 3/00

[52] U.S. Cl. ..... 362/222; 362/97; 362/223; 362/225; 362/231; 362/249; 362/251; 362/252; 362/260; 362/295; 362/311; 362/375; 362/396

[58] Field of Search ..... 362/97, 222, 223, 225, 362/231, 249, 251, 252, 260, 295, 311, 375, 396

[56] References Cited

U.S. PATENT DOCUMENTS 3,805,049 4/1974 Frank et al. ..... 362/231

4,071,883 1/1978 Dennis ..... 362/97

4,091,441 5/1978 Ott ..... 362/231

*Primary Examiner*—Stephen J. Lechert, Jr.

*Attorney, Agent, or Firm*—Robert E. Knechtel; Basil E. Demeur; Alan B. Samlan

[57] ABSTRACT

An illuminator or light box having the ability to provide varying degrees of light intensity or illumination to the screen. At least two sets of bulbs are mounted within the light box. Each set is identical to the other set and is comprised of different light bulbs. There are control switches to energize the same light bulb of each set. Different colored light bulbs can comprise the sets thereby allowing the user to selectively energize the lamps available to supply various colors to illuminate the screen.

10 Claims, 3 Drawing Figures

ILLUMINATOR BOX

BACKGROUND AND SUMMARY OF THE INVENTION

This invention relates to illuminator boxes which are commonly referred to as "light" boxes. The illuminator or light box is a commonly used device. One application is in reading x-rays. This has found increasing use in recent years as a tool for use in diagnosing medical problems and injuries of the body. The light box generally used in these applications consists of an enclosure housing several florescent light bulbs with a translucent plastic or glass screen on one face of the light box. The screen is illuminated when the lamps are energized and the x-ray is held against the screen for viewing. The light bulbs are either "on" or "off" and the light box has no ability to vary the amount of light striking the screen to illuminate it. Thus, the x-rays could only be read with one light intensity illuminating the screen and this light intensity was not variable. This presented a problem in that under or over exposed x-ray films could not be easily read as the illuminating light source was not adjustable to compensate for the poor quality of the x-ray exposure. Also, some x-rays have extremely dense or dark areas which are difficult to read on conventional light boxes as neither the intensity nor type of light is variable.

A second application of light boxes is in the graphic arts field. These are commonly referred to as "light tables." Often artists desire different colors of background lighting when creating their works. The conventional light tables used by artists have only one color of light source available, usually white. If other background lighting is required, the artist must remove the bulbs in the light table and replace them with the colored bulbs desired. Obviously, this is a major drawback, as the labor required to change bulbs is often substantial and therefore a major hindrance to the user.

When creating transparent overlays, a single colored background light is not always desirable. It would be a great aid to have lighting which could easily provide various color backgrounds. The artist can then easily try varying background color schemes while alternating overlays to determine the effect on the work. As more and more overlays are added to the work, the light intensity passing through the overlays is decreased. With conventional light boxes the light intensity cannot be varied and thus, the number of transparencies which can be built upon is solely dependent on the transmissivity or clarity of the overlays and the initial intensity of the light source. By putting in too strong of a light source, the initial overlay would be too bright and offensive to the artist. By using too dim of a light source, the light would not be bright enough to pass through several layers.

The present invention relates to a light box or light table for use in x-ray diagnosis, graphic arts color separation, parts inspection, photographic and hobby uses. It is particularly useful in any application wherein a light box is required which would have the capability of varying the amount of light illuminating the screen or in which various colors of light illuminating the screen are desirable.

According to one aspect of the invention, the amount of illumination may be varied by turning on different sets of bulbs. Thus, dark areas of x-rays or several overlays can be more easily read. Also, various lights, for example in medical diagnosis ultraviolet light may be substituted for the standard bulbs. Such a substitution can make the reading of some x-rays easier and more accurate, thereby improving diagnosis.

In another application of the invention, for example parts inspection, a soft, dim light might be advantageous for inspecting one type of part, while a brighter light might be required for inspecting a second dissimilar part. Without modifying the light box or installed illumination sources, applicant's invention could supply the required intensity and type of light by merely energizing the desired bulbs. In artistic applications, a blend of colors could be achieved by providing simultaneous light from two or more different lamps having distinct color values. By selectively choosing the desired lamps and color scheme, various end results can be achieved. Thus, the artist can easily experience the effects of individual or blends of colors on the work.

According to the specific embodiment illustrated in the drawings of this application and discussed in detail below, a light box is disclosed in which there are several sets of illuminating sources. Each set is identical to the other sets. Furthermore, each set contains two or more bulbs and it preferred that the bulbs be different in intensity, color or type of light emitted. By means of control switches, the sets of bulbs can be controlled so that the same type of bulb of each set can be separately energized apart from the other bulbs of the set. Alternatively, all the bulbs in each set can be energized. In this manner various light intensities can be achieved along with "blending" of colors or types of light. The number of sets can be varied along with the number of bulbs in each set.

Thus, it is an object of this invention to provide a light box having the ability to vary the intensity of light illuminating the screen. It is a related object to provide a light box having control means to vary the light intensity on the screen by controlling the number of light sources energized at one time.

Another object is to provide a light box having several colors of light sources which can be separately energized to provide blending of the selected colors. Another closely related object is to provide a light box having various light sources which can provide a specific type of light for improved medical diagnostic abilities.

Many other objects and purposes of the invention will be clear from the following detailed description of the drawings.

DETAILED DESCRIPTION OF THE DRAWINGS

Figure 1:
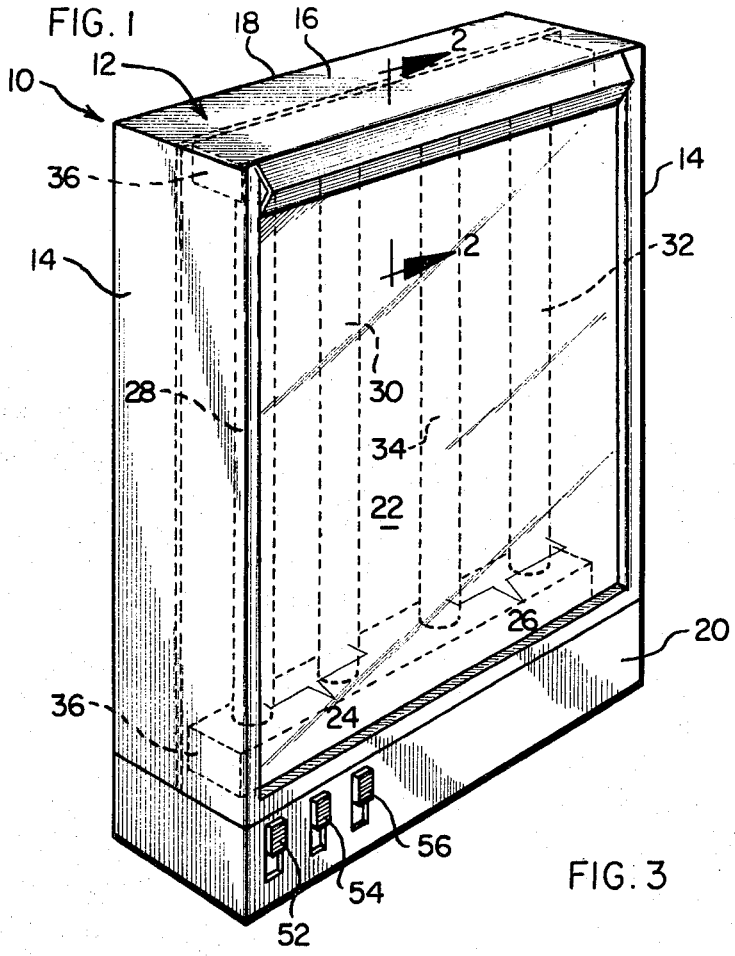
FIG. 1 is a perspective view of the inventive illuminator box with the screen removed.

Turning first to FIG. 1 there is illustrated an illuminator or light box 10 which illustrates one embodiment of this invention. It should be understood that the light box 10 could be a light table or similar device which could be used by artists or others in the art or graphic fields.

The light box 10 is comprised of an enclosure 12 having side walls 14, a top 16, a back wall 18 and bottom compartment 20. The side walls 14, top 16, back wall 18 and bottom compartment 20 are preferably light tight. Although light leakage would not make the box inoperable, it would interfere with its operation and probably hinder the user.

Located between the back wall 18 and the front of the box 10 is a supporting wall 22 which extends vertically from the top 16 to the top of the bottom compartment 20, and horizontally from side wall 14 to the opposite side wall 14. The supporting wall 22 is generally manufactured from sheet metal and has a highly reflective white glossy surface which will be described in more detail below.

Located against the supporting wall 22 are two sets of illuminating means, a first set 24 and a second set 26. The first set of illuminating means 24 is comprised of first and second illuminating sources or bulbs 28 and 30 respectively. The second set is similar and also comprised of first and second illuminating sources or bulbs 32 and 34 respectively. The bulbs 28, 30, 32 and 34 are illustrated as florescent bulbs and are retained against the supporting wall 22 by means of sockets 36 at each end of the bulbs.

Figure 2:
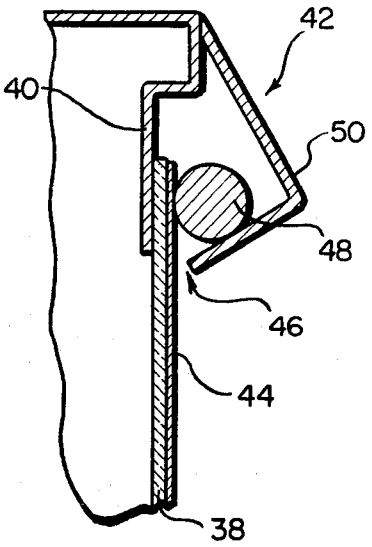
FIG. 2 is a cross sectional view taken along Line 2—2 of FIG. 1 illustrating a film clip used to hold an x-ray against the screen.

Placed in front of the bulbs and at the front of the enclosure 12 is a screen 38. The screen is of a translucent nature and can be manufactured from Lucite which is a trademark of E. I. Du Pont de Nemours and Company or a glass having similar translucent characteristics. Normally, the screen will be white so that the negatives or x-rays to be read are not influenced by any colors from the screen. The screen 38 is held into the enclosure 12 by means of a lip 40 which is illustrated in FIG. 2. If the light box 10 is of the type designed to read x-rays, there must be a means to hold the x-ray against the screen 38. FIG. 2 illustrates a film holder 42 which is one method used to achieve this result. The film or x-ray 44 is inserted into the film insert area 46 and is guided upwardly by the screen 38. A roller or bar 48 is retained by an angled arm 50 which is part of the enclosure 12. The film 44 will cause the roller 48 to be pushed upward and out of engagement with the screen 38. When the film 44 is released, the roller 48 will hold the film 44 against the screen 38 due to the force of gravity on the roller 48. When removal of the film 44 is desired, it is merely pulled out from the film insert area 46 and is released by the roller 48. Other means are also available to retain the x-rays or film against the screen which would be apparent to those skilled in the art.

When it is desired to view the x-ray or film 44, a master switch 52 located in the bottom compartment 20, is turned to the "on" position. To energize the first illuminating sources in each set, a first control switch 54 is then turned on. This causes the first illuminating sources or bulbs 28 and 32 of the first and second sets of illuminating means, 24, and 26, respectively, to be energized. Should additional illuminating light be necessary to read the film 44, then a second control switch 56 is turned on. This energizes the second illumination sources 30, 34 of the first and second illuminating means 24 and 26.

It can be seen that the first control switch 54 and second control switch 56 are operated independently of one another. Therefore, the first bulbs 28, 32 are operated independently of the second bulbs 30, 34. This results in three levels of light being available which are as follows: the first bulbs of each set can be on; the second set of bulbs can be on; or both sets can be on simultaneously creating a light level greater than either of the first or second light levels independently. The bulbs 28, 30, 32 and 34 all can be of the same color and wattage, resulting in the same illumination if either the first control switch or the second control switch were turned on with the other being off. However, the brightness would be affected if all four lamps were turned on by having both switches 54 and 56 in the on position. Alternatively, the bulbs 28 and 32 could be of one light color, while the second bulbs 30, 34 are of a second level of light color. One example is having the first bulbs 28, 32 of a "daylight" variety of florescent tube, while the second bulbs 30, 34 could be of a "cool light" variety. Under this combination, the user will have his choice of three separate light intensities, and two separate types of light quality, plus a combination of the two types of light.

Figure 3:
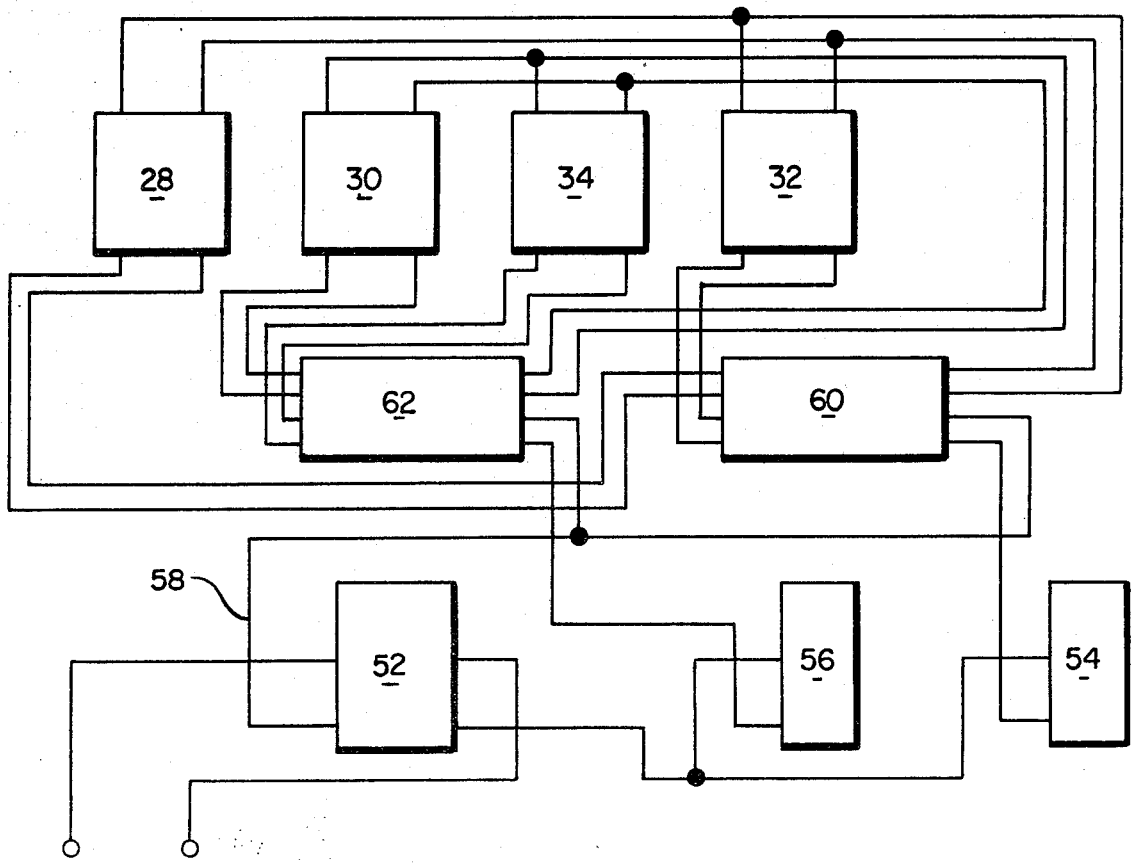
FIG. 3 is a schematic illustration of a control system used to selectively energize the illuminating sources.

FIG. 3 illustrates the electrical connections required to accomplish the switching described above. The master switch 52 is connected to the voltage source, or most commonly a 117 volt wall outlet. Power line 58 is wired into each of two ballasts 60, 62. These are standardly available as a ballast manufactured by General Electric Company and designated a Class P starter ballast Starter Number 8G3912. Ballast 60 is then wired to each of the bulbs 28, 32 which comprise the first illumination bulbs of each set 24, 26. Ballast 62 is wired to bulbs 30, 34 which comprise the second illumination sources of the sets. The master switch 52 is also wired to the first control switch 54 and the second switch 56. The first switch 54 is connected to ballast 60 and controls energization of the first bulbs 28, 32. The second control switch 56 is wired to ballast 62, and controls the second bulbs 30, 34.

As previously stated, the supporting wall 22 has a high gloss white surface; white enamel paint has been found to be satisfactory. This is to aid in reflecting as much light forward of the unit against the translucent screen 38 as practical. It also aids in disbursing across the screen 38 as much as the reflected light as possible. This help eliminate "hot spots" or areas of extreme brightness while minimizing the amount of "fall off" or diminishing brightness towards the edges of the screen.

Other combinations of bulbs are also available to achieve various results. For example, the first illumination source of each set might be of a standard "white light" design, while the second sources of each set might be an ultraviolet light. The ultraviolet light gives the ability to read extremely dark or dense x-rays, and could aid in diagnostics.

Other light colors and combinations are also available, including white, daylight, yellow, green, blue, red and numerous shades of each. Each set could be comprised of three, four, or more types or colors of bulbs. However, each set would preferably be identical to the other sets. Thus, if a red light was desired, then a control switch would operate the red lamp from each set. If a green light was desired, then the switch controlling the green lamp of each set would energize the green lamps. Combinations could be achieved by energizing the desired colors to be combined from each set to selectively blend the light colors. This would prove to be extremely valuable for artists or graphic designers working on light tables, as they often have the need to vary the color or shade of background lighting while they are creating overlays or graphic designs. With the inventive light box, as many colors of light bulbs as are practical could be placed in each set of illuminating means. Then by controlling a switch for each illuminating source or bulb out of each set, the operator can selectively pick his background light.

In a second embodiment, the light box 10 could have only one set of illuminating means comprised of two or more different bulbs. For example, the bulbs 28, 30, 32 and 34 could all be of different colors. Each bulb could be controlled individually by switching means such that any selected bulb or combination of bulbs can be energized. This would allow the user to blend the colors of the bulbs as desired.

Thus, it is apparent that there has been provided, in accordance with the invention, an illuminator box or light box that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A variable intensity illuminator box for reading x-rays and the like comprising:

a housing;

a translucent screen mounted on one side of the housing;

at least two sets of illuminating means supported within the housing, each of said sets being optically connected to and operable to illuminate the entire surface of the translucent screen;

at least two different illumination sources comprising each set of illuminating means;

control means operatively connected to each set of illuminating means to selectively energize one or more illumination sources of each set to illuminate the entire surface of the translucent screen, whereby variable degrees of intensity can be provided to read x-rays and the like supported on the translucent screen.

2. The illuminator box of claim 1 wherein each set of illuminating means comprises illumination sources which are identical with each other set.

3. The illuminator box of claim 2 wherein each set of illuminating means comprises two bulbs of different intensities.

4. The illuminator box of claim 3, wherein the control means comprises one control switch for each set of illuminating means with each switch operated independently of the other.

5. The illuminator box of claim 2, and further comprising clip means to hold one edge of a x-ray film negative against the side of the translucent screen opposite the side the light source is optically connected to so that the x-ray film negative can be viewed when the illumination means are energized.

6. The illuminator box of claim 1 wherein the illuminating sources are florescent bulbs.

7. The illuminator box of claim 1 wherein the two different illuminating sources are of different intensities thereby making available three different intensities to illuminate the screen by selectively energizing either one source of each set, the other source in each set, or both sources.

8. An illuminator box comprising:

a housing;

a translucent screen mounted on one side of the housing;

at least one set of illuminating means supported within the housing and operable to illuminate the entire surface of the screen;

the set of illuminating means comprised of bulbs having different color characteristics;

control means operatively connected to the illuminating means to selectively energize one or more of the bulbs in varying combinations to illuminate the entire surface of the screen whereby the colors from the bulbs can be selectively blended depending on the bulbs energized.

9. The illuminator box of claim 8 wherein the illuminating means comprises two or more sets of illuminating means with at least two bulbs of different color characteristics in each set.

10. The illuminator box of claim 9 wherein each set is identical to the other sets and the same colored bulb of each set can be selectively energized independently of the other bulbs in the set whereby the colors can be blended.

* * * * *